US006832607B2

(12) United States Patent
Zhou et al.

(10) Patent No.: US 6,832,607 B2
(45) Date of Patent: Dec. 21, 2004

(54) OUTDOOR COOK STOVE

(76) Inventors: Dongsheng Zhou, W63 N14262 Washington Ave., #83, Cedarburg, WI (US) 53012; Michael W. Loth, W153 N9899 Neptune Dr., Germantown, WI (US) 53022

( * ) Notice: Subject to any disclaimer, the term of this patent is extended or adjusted under 35 U.S.C. 154(b) by 0 days.

(21) Appl. No.: 10/618,778

(22) Filed: Jul. 14, 2003

(65) Prior Publication Data

US 2004/0045542 A1 Mar. 11, 2004

Related U.S. Application Data

(62) Division of application No. 10/158,700, filed on May 30, 2002, now Pat. No. 6,619,280.

(51) Int. Cl.[7] ..... F24B 3/00
(52) U.S. Cl. ..... 126/30; 126/9 R
(58) Field of Search ..... 126/30, 9 R, 40, 126/25 R, 42, 250

(56) References Cited

U.S. PATENT DOCUMENTS 3,759,164 A * 9/1973 Robinson ..... 99/413
4,108,142 A * 8/1978 Barson et al. ..... 126/41 R
4,553,524 A * 11/1985 Wheat et al. ..... 126/25 R
4,762,114 A * 8/1988 Blankemeyer ..... 126/373.1
5,979,428 A * 11/1999 Greene, Jr. ..... 126/38
5,992,407 A * 11/1999 Tsai ..... 126/40
6,439,107 B1 * 8/2002 Bourgeois ..... 99/340
6,619,280 B1 * 9/2003 Zhou et al. ..... 126/39 R
6,725,856 B1 * 4/2004 Barbour et al. ..... 126/50

* cited by examiner

*Primary Examiner*—Alfred Basichas

(57) ABSTRACT

A portable outdoor stove is provided which includes a burner primarily comprising an outer and inner pieces bolted tightly to form a small gas/air mixture chamber for accepting and maintaining high pressure gaseous fuel, a wind guard of cylinder shape capable of tightly coupled with a cooking vessel and possessing window opening of less than 180° toward its top for exhaust outlet, adjustable means for supporting the burner and positioning flame from burner onto bottom of cooking vessel and supporting means for the wind guard.

The burner possesses set of holes capable of directing high pressure combustion flame toward a upper center point concentrating heating power, extremely suitable for heating the bottom of a wok or any round bottom cooking vessel. With an adapter, another set of holes is capable of producing upward and outward spreading flame for flat bottom type cooking vessels. A protection guard can be put around the first wind guard preventing an operator accidentally touching the wind guard during cooking.

6 Claims, 6 Drawing Sheets

FIG. 2A
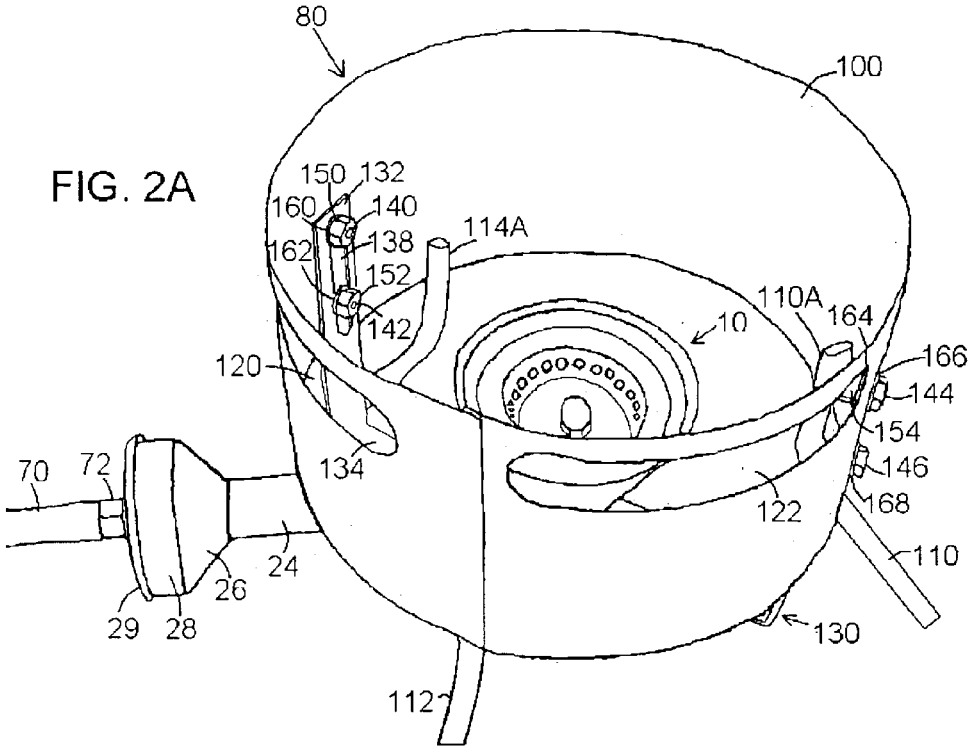
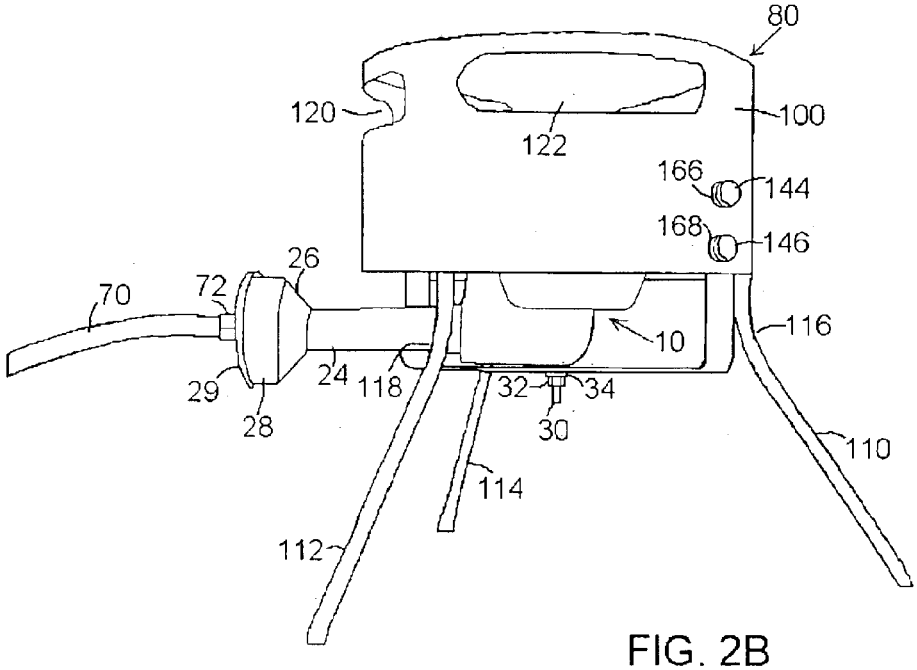
FIG. 2B

OUTDOOR COOK STOVE

This application is a DIV of Ser. No. 10/158,700 filed May 30, 2002 now U.S. Pat. No. 6,619,280.

U.S. PATENT DOCUMENTS

| | | | |
|---|---|---|---|
| 4,062,341 | December 1977 | Panzarella | 126/41 R |
| 5,158,067 | October 1992 | Dutro et at. | 126/39 R |
| 6,234,064 | May 2001 | Turrel | 99/323.9 |
| 6,098,611 | August 2000 | Filmore | 126/50 |
| D386,936 | December 1997 | Stone et al. | D7/332 |
| 4,553,524 | November 1985 | Wheat et al. | 126/25 R |
| 4,353,347 | October 1982 | Seed | 126/41 R |
| 5,775,316 | July 1998 | Jones | 126/41 R |
| 4,555,616 | November 1985 | O'Brien | 219/432 |
| 5,044,352 | September 1991 | Lok | 126/39 R |
| 5,226,406 | July 1993 | Reynolds | 126/39 R |
| 4,583,941 | April 1986 | Elperin et al. | 41/347 |

BACKGROUND OF THE INVENTION

1. Field of the Invention

The present invention relates to an outdoor cook stove utilizing high pressure gaseous fuel, in particular a stove for domestic or industrial gas cooking using bottled gas, and is suitable for round bottom cooking vessels.

2. Brief Description of the Prior Art

There are various attempts for outdoor stove manufacturers to accommodate cooking for round bottom vessels such as a wok. Barbecue equipment makers make wok adapter to sit on top of fire grid. However the fire grid is not powerful enough and the entire structure is not efficient enough for wok cooking. Authentic, restaurant quality oriental wok cooking requires a stove capable of generating more than 100,000 BTU in power. Such power is beyond reach of single ring low pressure gas stoves. In commercial and industrial wok cooker, as partially illustrated in U.S. Pat. No. 5,315,983, either multi-rings or multiple jet burners are used to achieve the necessary power. Another drawback of using low pressure gaseous fuel is its stove being more susceptible to wind during outdoor cooking.

U.S. Pat. Nos. 5,158,067 and 4,062,341 taught outdoor stove construction for wok cooking. However they share several disadvantages that prevent them from reaching high quality oriental cooking. The first is the low pressure gaseous fuel which prevents their stoves from reaching 100,000 BTU in power. The second disadvantage is the low pressure burner which they utilize does not have center flame heating to the bottom of a wok. As with a bowl shape, it is most important to direct the burning flame toward the bottom of a wok for efficient heat transfer. The disadvantage of not using a center flame is in many burner designs, for example U.S. Pat. Nos. 6,234,064, 6,098,611, D386,936, 4,553,524, 4,353,347. The flame coming out from all these burners spread outward, leaving a sizable center portion of the cooking vessel relying on metal conducting heat back to its center. For a wok, this heat conducting downward to its bottom is extremely inefficient.

Yet another disadvantage of the aforementioned stove constructions is to allow the flame to extend above the wok along its outside surface. Since wok cooking requires an operator to stay closely and maneuver the wok in different ways, the flame coming out can easily burn and hurt the operator. Such examples can be found in U.S. Pat. Nos. 4,062,341, 6,098,611 and 5,775,316. Because of this reason, the operator is forced to reduce power of the stove to stay safe. For low pressure gaseous stove ranges like in U.S. Pat. Nos. 5,044,352 and 5,226,406, expensive exhaust duct mechanism is built for routing the flame and exhaust away from the operator.

U.S. Pat. Nos. 6,234,064, 6,098,611, D386,936, 4,555,616 and 4,353,347 taught to have fixed center burner position with respect to bowl shape cooking vessel. Such fixed position defines fixed heating power distribution to the vessel, forcing the operator to frequently toss foods to various locations in order to receive different heating power. Fixed position between stove and wok greatly restricts the freedom for the operator to tilt and rotate the wok for various food items to receive different flame power, which is necessary when the food items are too fragile to be tossed.

U.S. Pat. No. 4,583,941 taught a burner construction on how to form flame inwardly around an imaginary cylinder. Although the flame is inwardly directed, it still does not heat the center portion of its cooking vessel. Another drawback is that as required by its inward flame, the burner has a bigger chamber for pre-mixed gaseous fuel and air. This big chamber inevitably reduces the mixture gas pressure and hence the power of the burner.

It is the objectives of the present invention to overcome aforementioned drawbacks.

SUMMARY OF THE INVENTION

The first objective of the present invention is to utilize high pressure gaseous fuel to achieve highest power for wok cooking with simple burner construction to save cost significantly over traditional high power wok cookers with low pressure gaseous fuel.

The second objective of the present invention is to construct a burner to produce a concentrating inward flame. This flame is directed to the bottom of the cooking vessel (wok) and naturally extends upward along the wok outside surface. In this way heat is first concentrated at the wok bottom and then spread along the outer surface.

The third objective of the present invention is to construct an outdoor stove with a wind guard ring tightly hosting a wok. A portion of the wind guard has openings close to the wok for directing out the flame and exhaust. It also provides access for burner ignition. This portion is to be positioned away from the operator during operation. The rest portion of the wind guard does not have opening to prevent any flame from extending along its side. The operator is positioned along this side for safe operation. This wind guard defines the heating area to the wok and is sized around 8"–10" in diameter for commonly available woks.

The fourth objective of the present invention is to add a second ring outside the first wind guard to prevent the operator from accidentally touching the hot surface of the first wind guard.

The fifth objective of the present invention is to construct a stove to give complete freedom to the wok operator. The wok is not required to be fixed in position to the stove. The operator can tilt and move the wok in his/her own will at any time in order to achieve best cooking result.

The sixth objective of the present invention is to construct a burner to maintain high gas pressure within the gas chamber before ejecting for ignition. Maintaining high gas pressure all way through the burner guarantees its rated power delivery.

The seventh objective of the present invention is to have burner position adjustable within the stove to accommodate both round and flat bottom cooking vessels for optimum heat transfer.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particular shown are by way of example and for purpose of illustrative discussion of the preferred embodiments of the present invention only. They are presented in the cause of providing what is believed to be the most useful and readily understood description of the principles and conceptual aspects of the invention. In this regard, no attempt is made to show structural details of the invention in more detail than is necessary for a fundamental understanding of the invention. The description together with the drawings should make it apparent for those skilled in the art how the several forms of the invention may be embodied in practice. In the drawings:

FIG. 2A is a perspective view of a first embodiment of an outdoor stove incorporating the embodiment of FIG. 1A, as well as a wind guard ring and an adjustable metal strip for holding the burner.

FIG. 2B is a side elevated view of the embodiment of FIG. 2A showing how the burner is bolted on the strip.

DETAILED DESCRIPTION OF THE PREFERRED EMBODIMENTS

Figure 1A:
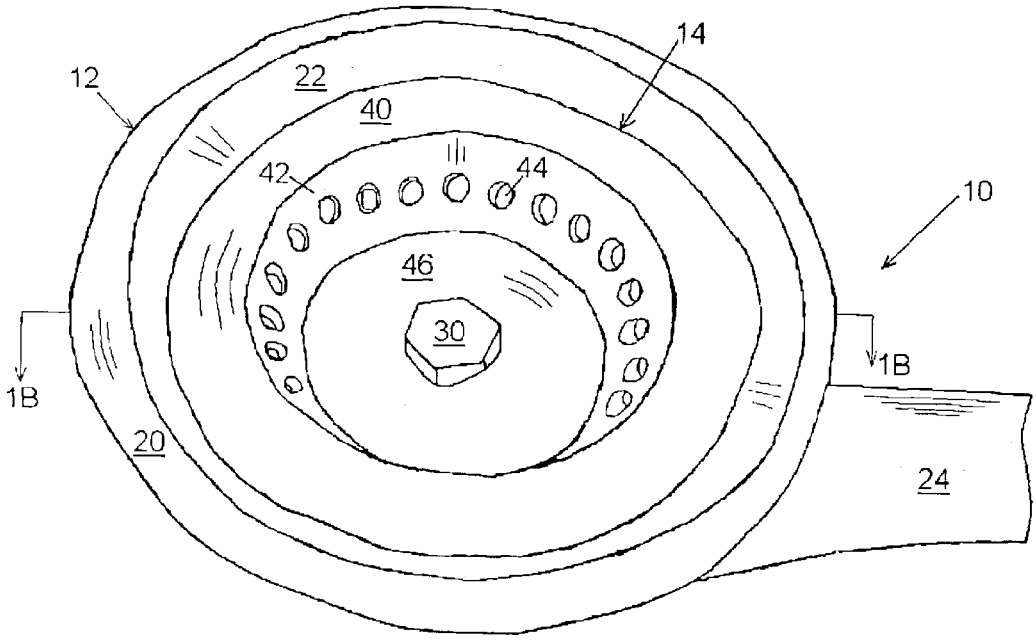
FIG. 1A is a perspective view of the first embodiment of an outdoor burner constructed according to the present invention showing its burner head with all flame holes inwardly directed.
Figure 1B:
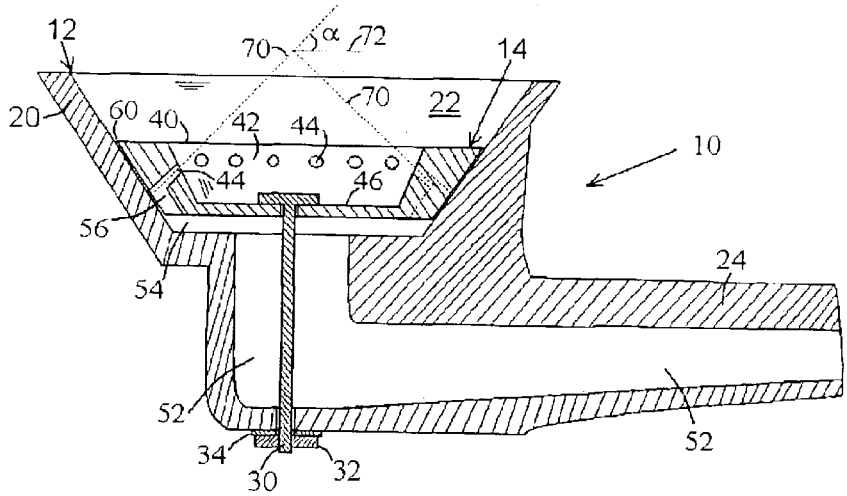
FIG. 1B is a side cross section view of the embodiment of FIG. 1A showing detailed construction of the flame holes all directing toward a center point.

An outdoor burner constructed according to the preferred embodiment of the present invention is indicated generally at 10 in FIG. 1A. The burner 10 includes an outer piece 12 housing an inner piece 14. Both pieces are tightened together by a bolt 30, nut 32 and washer 34. The entire burner can be made by cast iron. Piece 12 generally has a cone like upward and outward inner surface 22 which is to be coupled with outer surface of piece 14 tightly. Bolt 30, hut 32 and washer 34, illustrated in FIG. 1B, enforce the tight coupling. The resulting gap 60 does not pass any gaseous fuel out along the slope 22. The center of outer piece 12 is a hollow airway 52. Airway 52,usually leads to a venturi opening 28 for inlet of mixed gaseous and air. The ratio of gas to air mixture coming from venturi opening 28, shown in FIG. 2A, through a narrower section 26 to airway 52 can be adjusted by a perforated plate 29. The structure of the venturi opening and its gas/air inlet ratio adjustment is well known in the art. Their detail drawing are not given here.

The vertical section of the airway 52 and a section 54 between pieces 12 and 14 form a chamber for the gas and air mixture. The small area 54 formed between outer and inner pieces 12 and 14 insures the mixture to remain in high pressure. From this chamber the mixture is directed through hole 56. Hole 56 then turns the mixture into holes 44. From holes 44 the mixture ejects out and combusts. Holes 44 are equally spaced, and have a upward slope of $\alpha$ degree with respect to horizontal plane $\alpha$ can be selected in a wide range and is preferably between 10°–85°. The taller wall 20 of piece 12 serves as an additional wind guard for the combustion flame coming out from holes 44. Since holes 44 are arranged as inward and upward, combustion flames from individual holes 44 are cone shaped and concentrated to a point above burner 10.

Figure 2C:
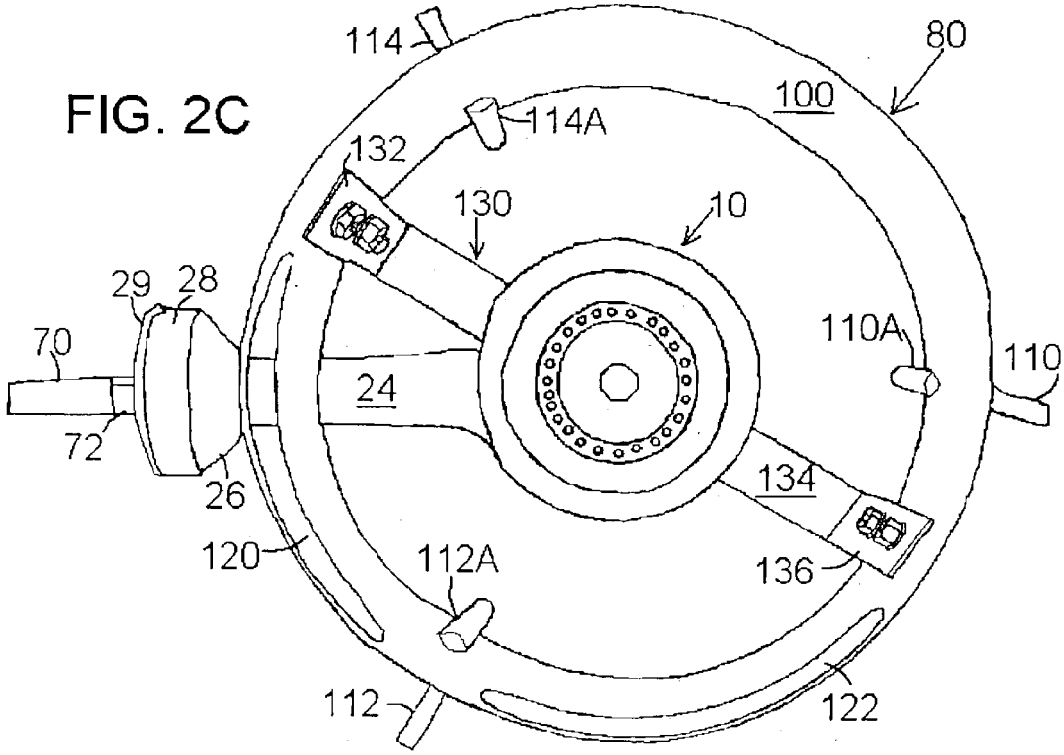
FIG. 2C is a top view of the embodiment in FIG. 2A showing details of the mounting strip and three supporting legs.

FIG. 2A illustrates an outdoor stove 80 constructed according to the preferred embodiment of the present invention. Although stove 80 is specially designed to handle outdoor cooking using a round bottom cooking vessel, stove 80 is also suitable for flat bottom vessel cooking. Stove 80 includes a preferred burner 10 of present invention. Burner 10 is mounted on a metal bar 130 using the same bolt 30, nut 32 and washer 34. Burner 10 directs its flames inward and upward to a concentrating point. This point can be aligned with the bottom of a wok by metal bar 130. Metal bar 130 has a horizontal section 134. In the center of 134 a hole is drilled for bolt 30 to come through, better viewed in FIG. 2B. Burner 10 is mounted on 134 and position of the venturi pipe 24 can be adjusted horizontally for convenient inlet of gas pipe 70. Metal bar 130 also includes two vertical sections 132 and 136 at both ends. These two vertical sections 132 and 136 have slot openings. For example, vertical 132 has a slot 138. Two bolts 140, 142, two nuts 150, 152 and two washers 160, 162 are used to fasten the slot 132 to a supporting ring 100. Similar construction is done on another side 136. Vertical positioning of the metal bar 130 along ring 100 is accomplished by adjusting the slots with respect to the bolts. In this way the concentrating flame point can always be adjusted to touch the bottom of various woks and other round bottom vessels. The length of section 134 is about the same as the diameter of ring 100.

Ring 100 serves multiple purposes. It can support a wok for cooking. A wok can sit right on ring 100. The diameter for ring 100 is preferably between 8" to 10". Ring 100 is constructed as a cylinder shape to house a wok with minimum gap. After heating the bottom of the wok, the concentrated combustion flame is split up along the wok outer surface. Because of small gap between wok and ring 100, the flame is not able to penetrate out of the gap. Instead, it is forced to use windows 120 and 122 for exhaust purpose. In this way the ring defines the heating area to the wok. Since windows 120 and 122 have limited opening on ring 100, their openings define limited unsafe area for an operator. When an operator is working away from these openings (windows 120 and 122), there is no flame coming up along the outer surface of the wok to cause damage.

The total opening angle along ring 100 is preferably less than 180° such that no direct wind can blow through burner 10. In this way ring 100 serves as a wind guard. Ring 100 also supports metal bar 130 for burner 10. Four holes are drilled for mounting bolts for slots along 132 and 136.

Ring 100 is further supported by three legs 110, 112 and 114. Construction for each leg is similar. A bend at 116 for leg 110 is to increase its bottom perimeter to enhance stability of the entire stove 80. Top end 110A of leg 110 is welded to a lower position of ring 100. Legs 110, 112 and 114 are preferably spread out in 120°.

To start cooking, high pressure gaseous fuel is supplied through a high pressure regulator. Ejected combustion gas and air mixture from holes 44 can be ignited by an outdoor igniter through either ring windows 120, 122 while a wok is already sitting on top of ring 100. Alternately, the wok can be temporally moved away for an ignitor to ignite the flame through top of ring 100.

Figure 3:
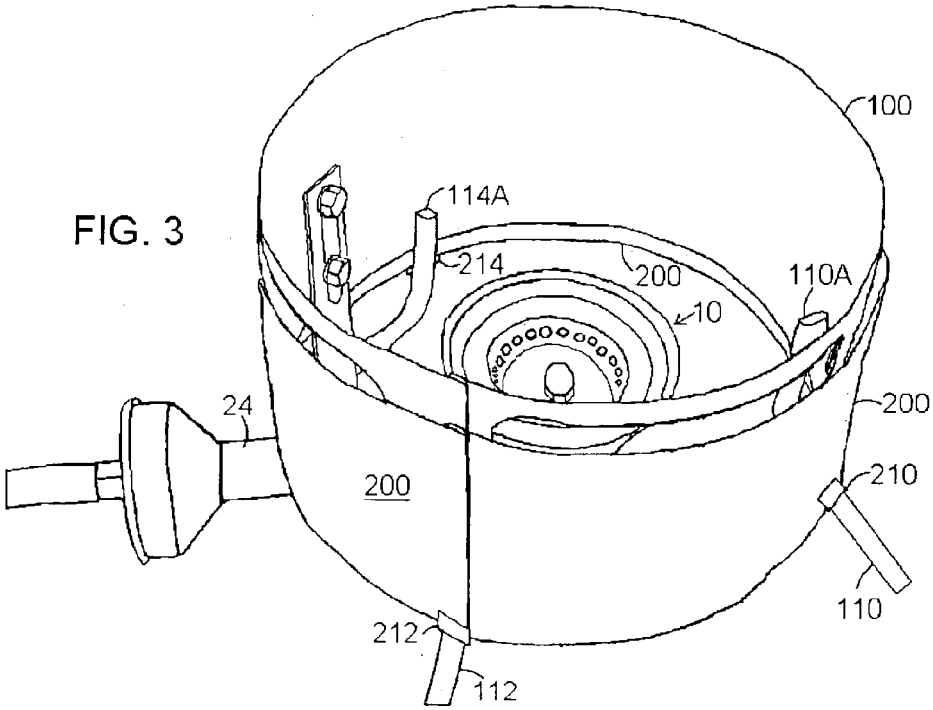
FIG. 3 is a perspective view of a second embodiment of an outdoor stove with a second wind guard ring encircling the first ring.

A second stove embodiment of the present invention is shown generally in FIG. 3. Since ring 100 prevents flame from burner 10 to reach the operator on the opposite side of windows 120 and 122, the heat is trapped within ring 100 for the energy to be transferred to a wok. When burner 10 is adjusted to its upper power range, ring 100 may warm up and be hazardous to touch. Although there is little chance for the operator to touch ring 100 because the operation is accomplished by using wok handles at least half foot away from ring 100, a second ring 200 can still be added outside of ring 100 to protect ring 100 from being reached. Various mounting technique can be used for ring 200. Three metal pieces 210, 212 and 214 are welded upwardly on legs 110, 112 and 114. Piece 210 and leg 110, piece 212 and leg 112, piece 214 and leg 114 together define three junction points for ring 200 to rest on. The height of ring 200 is constructed lower than that of ring 100, preferably half inch. In this way a wok is still supported by ring 100 and exhaust flame can still come out from windows 120 and 122. Aforementioned features of ring 100 are preserved. Since ring 200 is not heated by flame from burner 10, it will remain cool during on-going cooking process. An alternate mounting for ring 200 is to weld it directly on legs 110, 112 and 114. Ring 200 does not need to be solid, it can be perforated as long as it can prevent the operator's fingers to reach in to ring 100.

Figure 4A:
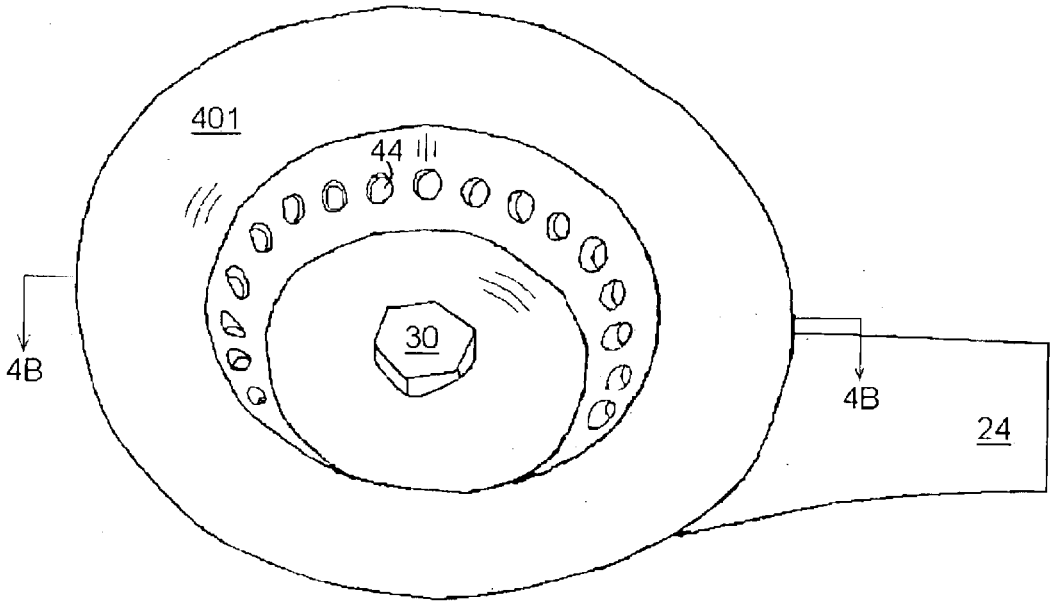
FIG. 4A is a perspective view of a second embodiment of an outdoor burner with the inner piece extending over the top of the outer piece.
Figure 4B:
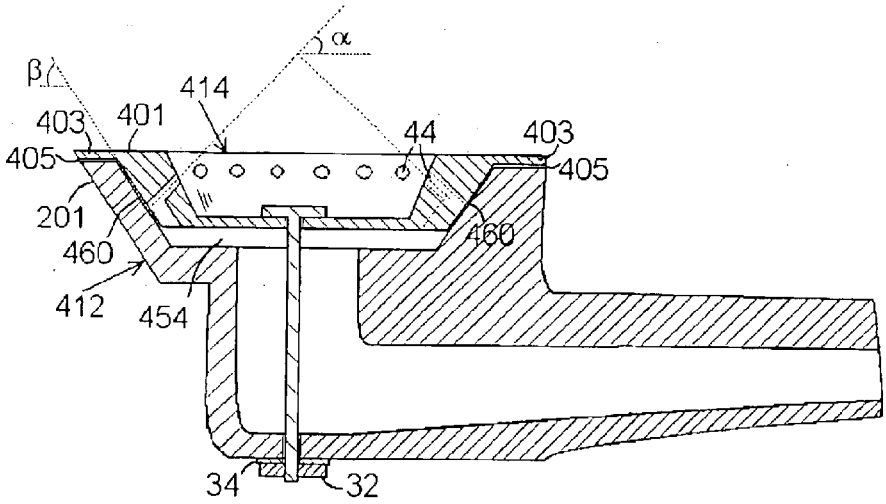
FIG. 4B gives a cross section view of the embodiment of FIG. 4A showing its internal construction.

A second burner embodiment of the present invention is illustrated in FIGS. 4A and 4B. Outer piece 412 is below the inner piece 414. Surface 401 of piece 414 has edge 403 extended covering the top perimeter of outer piece 412. Bolt 30, nut 32 and washer 34 clamp gap 405 as minimum between inner and outer pieces 414 and 412. Gap 405 does not pass gaseous fuel and forces the fuel to go through holes 44. Because of gap 405's function, gap 460, formed by both upward slopes of inner and outer piece 414 and 412, does not need to be tight, not as required by the first embodiment illustrated in FIGS. 1A and 1B. However, gap 460 should remain small to maintain a small size of gas/air chamber 454. Since gap 460 is not required for preventing gaseous leakage, angle β between slope of gap 460 and horizontal plane can be increased up to 90°. In other words, slope of gap 460 can be upward and outward or simply upward.

Figure 5A:
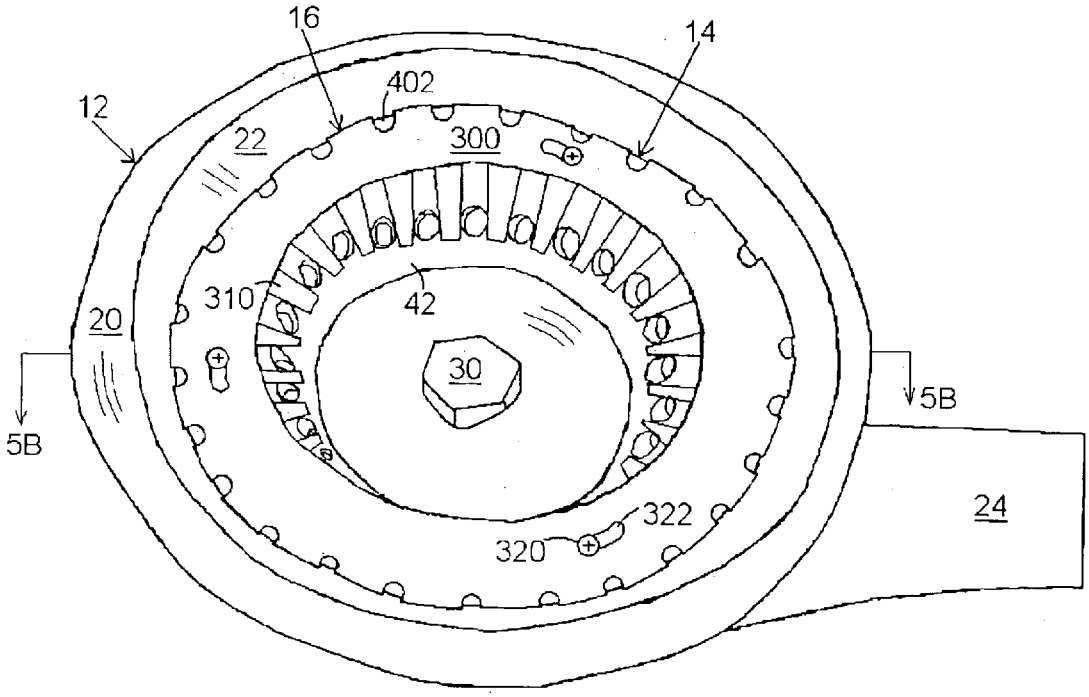
FIG. 5A is a perspective view of a third embodiment of an outdoor burner with adjustable flame direction. This view shows inward flame selection.
Figure 5B:
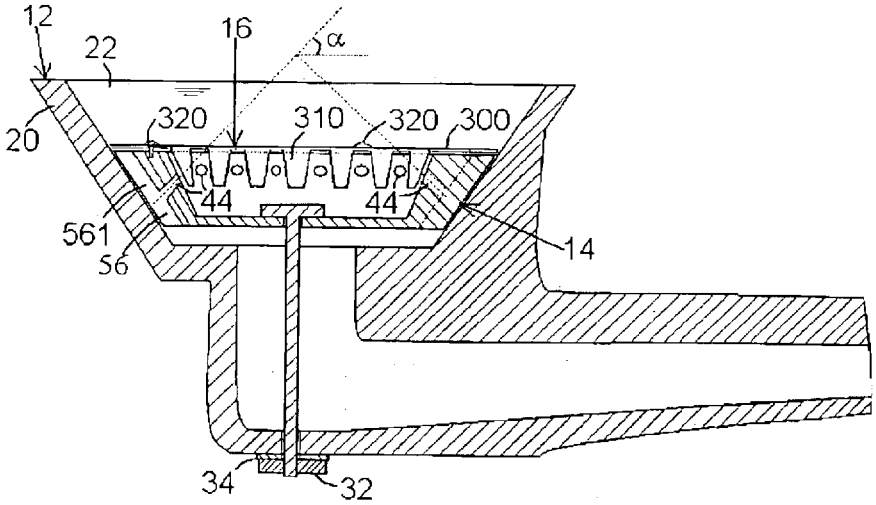
FIG. 5B is a cross section view of the embodiment of FIG. 5A showing a burner selection for inward flame.
Figure 6A:
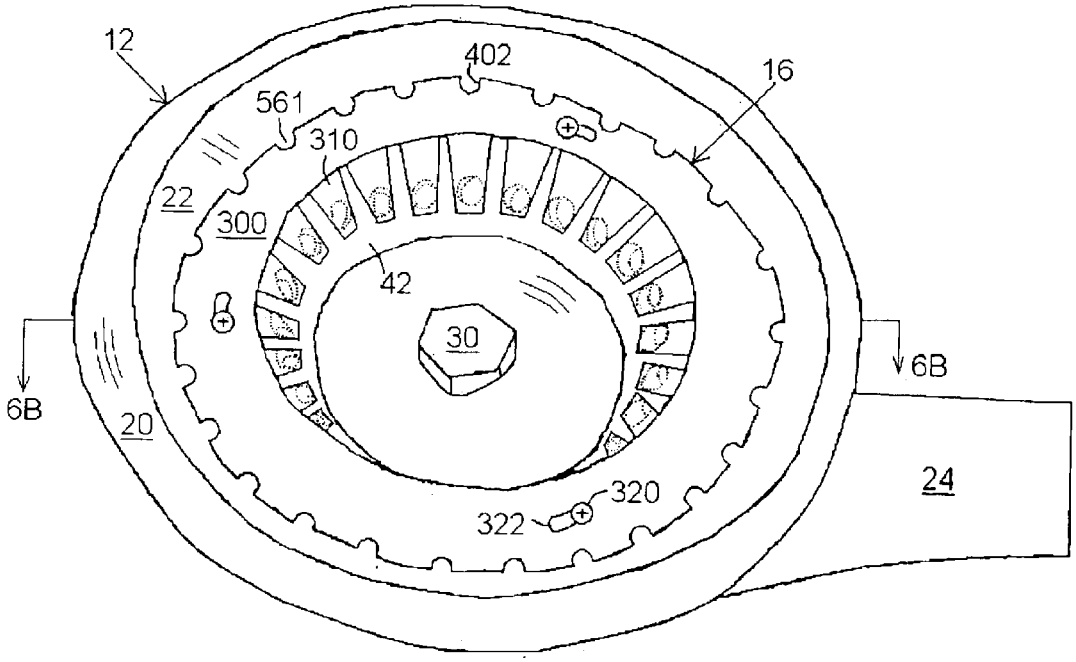
FIG. 6A is an alternative perspective view of the embodiment of FIG. 5A showing a burner selection for outward flame.
Figure 6B:
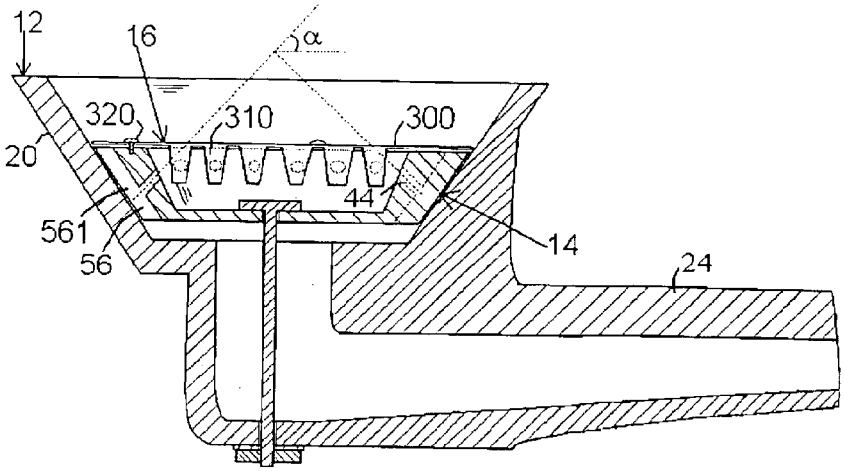
FIG. 6B is a cross section view of the embodiment of FIG. 5A corresponding to FIG. 6A.

A third burner embodiment of the present invention is shown from FIGS. 5A to 6B. In addition to inward and upward holes 44, a group of slots 561 are constructed in equal distance along perimeter of inner piece 14. Slots 561 are connected with slots 56 along outer surface of inner piece 14. After being tighten down by bolt 30, nut 32 and washer 34, slots 561 and slope 22 of the outer piece 12 form holes that can deliver combustion flame outwardly and upwardly. An adapter 16 is added on top of inner piece 14. Adapter 16 has a flat surface 300 covering surface 40 of inner piece 14. On perimeter of 300 there are slots 402. Adapter 16 also include fins 310 bent along surface 42 of inner piece 14. Flat surface 300 has three slots 322 through which screws 320 tie adapter 16 down with inner piece 14. Slots 322 and screws 320 also allow relative position of adapter 16 to be adjusted with respect to inner piece 14. FIGS. 5A and 5B show the adapter in a position blocking slots 561 and directing the combustion flame through holes 44 inwardly and upwardly. In this way gaseous fuel is directed from slots 56 to holes 44.

Before cooking, screws 320 can be loosen and position of slots 402 can be adjusted to align with slots 561 of inner piece 14. In the mean time, fins 310 block holes 44, preventing combustion fuel from coming out from holes 44. Instead, the combustion fuel is directed through slots 56 and then 561 upwardly and outwardly. With this upward and outward combustion flame, the burner can be used for flat cooking vessel, for example, deep fry turkey pan. Again the height of the burner against the flat bottom of the cooking vessel can be adjusted by metal bar 130.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive. The scope of the invention will be indicated by the appended claims rather than by the foregoing description. And all changes, which come within the meaning and range of equivalency of the claims, are therefore intended to be embraced therein.

What is claimed is:

1. A portable outdoor stove for cooking foods comprising:

a burner accepting pressured gaseous fuel to produce high power output, and ejecting combustion flame through holes, directing their flames to a center area above, a cylinder shape wind guard surrounding said burner readily accepting a cooking vessel, and a smell gap being formed between said wind guard and said vessel tight enough to prevent flame coming out to hurt operator, said wind guard having windows opening toward its top on opposite side of the operator for exhaust flame outlet and still preserving said wind guard function, a means to support said wind guard, and a metal bar with vertical ends attaching to bottom of said wind guard, to support said burner for aligning said center area of said flames to said bottom of said vessel, said burner can be rotated with respect to a mounting bolt in center of said metal bar, whereby said flames deliver highest heating power to bottom of said cooking vessel in a safe and stable manner.

2. The stove of claim 1, wherein said cooking vessel is a wok, or any round bottom and flat in shape.

3. The stove of claim 1, wherein said supporting means for said wind guard comprises three simple legs.

4. The stove of claim 1, wherein said vertical ends of said metal bar have slot openings and can be mounted with bolts on said wind guard, position of said bar is adjustable by relatively positioning said slot openings with respect to bolts on said wind guard.

5. The stove of claim 1, further comprising a means to surround said wind guard to prevent the operator from accidentally touching said wind guard during cooking.

6. The stove of claim 1, wherein an outer perimeter surface of an inner piece of said burner further comprises equally spaced slots extending through from bottom to top, an inner perimeter surface of said inner piece of said burner comprises equally spaced holes upward and inward, and said inner niece is attached to an adapter with a flat surface having same number of slots on its outer perimeter as those of said inner piece and said same number of inside fins bent to fit the inner perimeter shape of said inner piece, and said adapter is adjustably mounted on said inner piece for said slots and fins to cover either holes or slots on said inner piece and never both, forcing high pressurized gas and air mixture through said holes to form inward, upward and concentrating combustion flame joining at a center point above, or through said slots of said inner piece along the inner surface of an outer piece of said burner to form outward, upward and spread out combustion flame.

* * * * *